US010712101B2

(12) United States Patent
Guerra et al.

(10) Patent No.: US 10,712,101 B2
(45) Date of Patent: Jul. 14, 2020

(54) FIRE TUBE

(71) Applicant: ROBUR S.P.A., Verdellino, (BG) (IT)

(72) Inventors: Benito Guerra, Verdellino (IT); Giovanni Scubla, Verdellino (IT); Jvan Benzoni, Verdellino (IT)

(73) Assignee: ROBUR S.P.A., Verdellino (BG) (IT)

( * ) Notice: Subject to any disclaimer, the term of this patent is extended or adjusted under 35 U.S.C. 154(b) by 0 days.

(21) Appl. No.: 15/775,170

(22) PCT Filed: Nov. 9, 2016

(86) PCT No.: PCT/IB2016/056733

§ 371 (c)(1),
(2) Date: May 10, 2018

(87) PCT Pub. No.: WO2017/085592

PCT Pub. Date: May 26, 2017

(65) Prior Publication Data

US 2018/0328674 A1 Nov. 15, 2018

(30) Foreign Application Priority Data

Nov. 18, 2015 (IT) ..... UB2015A5713

(51) Int. Cl.
*F28F 1/40* (2006.01)
*F22B 37/06* (2006.01)
(Continued)

(52) U.S. Cl.
CPC ..... *F28F 1/40* (2013.01); *F22B 37/06* (2013.01); *F24H 9/0026* (2013.01); *F28F 13/06* (2013.01)

(58) Field of Classification Search
CPC ..... F28F 1/40; F28F 13/06; F28F 3/02; F28F 1/34; F28F 1/36; F28F 2215/04; F28F 13/12
(Continued)

(56) References Cited

U.S. PATENT DOCUMENTS 4,470,452 A * 9/1984 Rhodes ..... F28D 1/0391 165/153
5,458,191 A * 10/1995 Chiang ..... F28F 1/40 165/133
(Continued)

FOREIGN PATENT DOCUMENTS

DE 8531100 U1 10/1987
DE 102005029321 A1 12/2006

OTHER PUBLICATIONS

International Search Report for International Application No. PCT/IB2016/056733 ( 11 Pages) ( dated Mar. 29, 2017).
(Continued)

*Primary Examiner* — Patrick F Brinson
(74) *Attorney, Agent, or Firm* — Lucas & Mercanti, LLP

(57) ABSTRACT

A flame tube having a tubular body with an inner side surface, extending around an axis (A), an inlet section and an outlet section, a plurality of fins leaning out, substantially in the radial direction (R), from the inner side surface towards the axis (A) is provided. The fins have an extended surface whose tangent (T), in a point (C) normal to the radial direction (R), is skew with respect to the axis (A), a first and a second fin forming an interspace between the respective extended surfaces facing one another and whose ideal extension (P) in the direction of the tangent (T) encounters a third fin.

10 Claims, 4 Drawing Sheets

(51) Int. Cl.
*F24H 9/00* (2006.01)
*F28F 13/06* (2006.01)

(58) Field of Classification Search
USPC ..... 138/37–39; 165/184, 133, 177, 181, 179
See application file for complete search history.

(56) References Cited

U.S. PATENT DOCUMENTS

| | | | | |
|---|---|---|---|---|
| 5,913,289 | A | 6/1999 | Gerstmann | |
| 6,412,549 | B1 * | 7/2002 | Itoh | F28F 1/40 165/133 |
| 6,675,746 | B2 | 1/2004 | Gerstmann et al. | |
| 6,935,418 | B1 * | 8/2005 | Valaszkai | F28F 1/022 165/109.1 |
| 6,957,487 | B1 * | 10/2005 | Valaszkai | B21C 37/151 29/890.03 |
| 7,011,150 | B2 * | 3/2006 | Komatsubara | F28F 1/42 165/177 |
| 7,055,586 | B2 * | 6/2006 | Sakakibara | F28D 7/1684 138/38 |
| 2010/0307729 | A1 | 12/2010 | Sarkisian et al. | |

OTHER PUBLICATIONS

Italian Search Report for Corresponding Italian Application No. IT UB20155713 (2 Pages) (dated Jul. 20, 2016).

* cited by examiner

FIRE TUBE

CROSS-REFERENCE TO RELATED APPLICATIONS

This application is a 371 of PCT/IB2016/056733, filed Nov. 9, 2016, which claims the benefit of Italian Patent Application No. UB2015A005713, filed Nov. 18, 2015.

The present invention relates to a fire tube according to the preamble of the main claim.

FIELD OF THE INVENTION

Fire tubes are used to transmit heat between hot fumes passing inside the tube, and a fluid external to the tube, generally a liquid.

BACKGROUND OF THE INVENTION

Fire tubes usually have finning arranged on the inner surface of the tube, in order to increase the heat exchange efficiency.

Such fire tubes can be used in different types of plants such as for example heat exchangers or boilers.

Hot fumes produced by combustion pass through a fire tube. The combustion can also occur in the first length of the fire tube. The fire tube should internally withstand temperatures ranging from 1200° C. in the inlet section (base) to 40° C. in the outlet section (head), where the fumes have cooled.

In the absorption air-conditioning systems such fire tubes are used to release heat to an admixture of water and ammonia, in order to separate ammonia from water, thus obtaining ammonia vapor at the head and a liquid solution poor in ammonia at the base.

In such plants a fire tube is subjected to high external pressure, usually up to 35 bars, that tends to make it collapse. The standards set out that the fire tube in such plants should withstand an external pressure of four times the design pressure. For this reason, the side wall of the fire tube must have thickness adequate to withstand the difference of pressure between the outside and inside.

Also the difference of temperature among the various parts of the fire tube causes different thermal expansion and consequent structural stress or thermal stress.

Fire tubes must therefore ensure good heat exchange coefficient, high resistance to temperatures, high structural resistance to external pressure and thermal stresses.

Different fire tubes are known in the field of art.

In US 2010/0307729 A1 a fire tube is described, having longitudinal fins arranged on the inner surface. Such fins are made with U-shaped profiles for an easier connection to the inner surface of the tube. Furthermore, the height of the fins increases moving closer to the outlet section and are arranged on rings.

In U.S. Pat. No. 5,913,289 a fire tube is described having a corrugated metal sheet applied on the inner surface, in order to improve the heat exchange. Such a metal sheet is however subjected to significant thermal stress.

In U.S. Pat. No. 6,675,746 B2 the fins on the inner surface of the fire tube are formed by pins, in order to improve the resistance to thermal stress.

A problem with the fire tubes is the reduced efficacy of the heat exchange.

Another problem is related to pressure drop, specifically due to the narrowing of the passage section, such as for example in US 2010/0307729 A1 when fumes pass from a fin ring to the following one.

Another problem is to obtain uniform temperature distribution, or a desired temperature profile, on the outer surface of the fire tube.

Another problem is to improve the structural resistance of the tube against both the pressure difference between outside and inside, and thermal stresses.

SUMMARY OF THE INVENTION

Object of the present invention is therefore to achieve a fire tube that allows overcoming the mentioned drawbacks, in particular an object is to implement a fire tube with better heat exchange coefficient.

Another object is to implement a fire tube in which a more uniform temperature of the outer surface is obtained, or a desired distribution of the temperature on the outer surface.

A further object is to implement a fire tube with higher resistance to external pressure.

Said objects are achieved by a fire tube whose inventive features are highlighted by the claims.

BRIEF DESCRIPTION OF THE DRAWINGS

The invention will be better understood by the following specification provided for illustration purposes only, thus without limitation, of a preferred embodiment illustrated in the accompanying drawings in which.

DETAILED DESCRIPTION OF THE INVENTION

Figure 1:
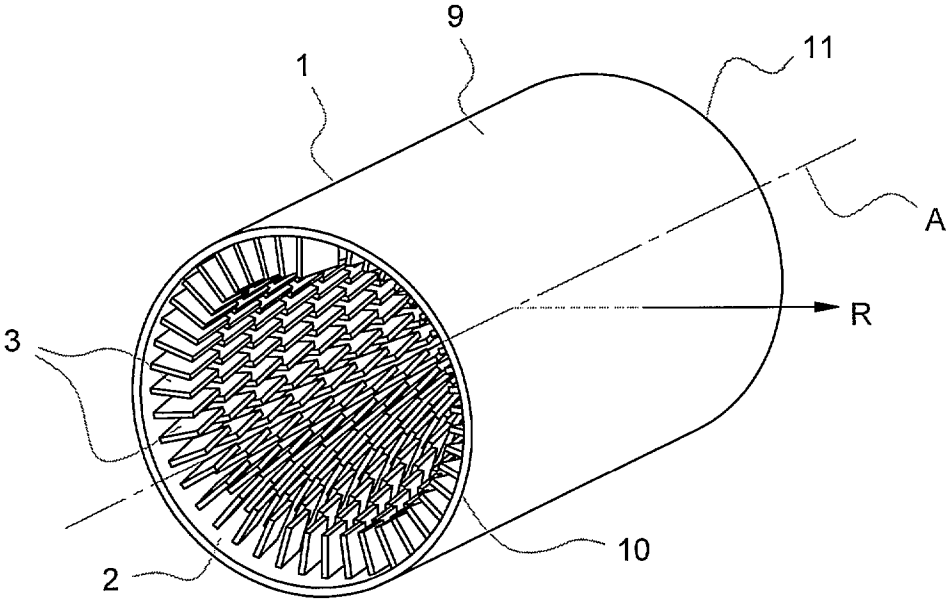
FIG. 1 shows a perspective view of a fire tube according to the invention.
Figure 2:
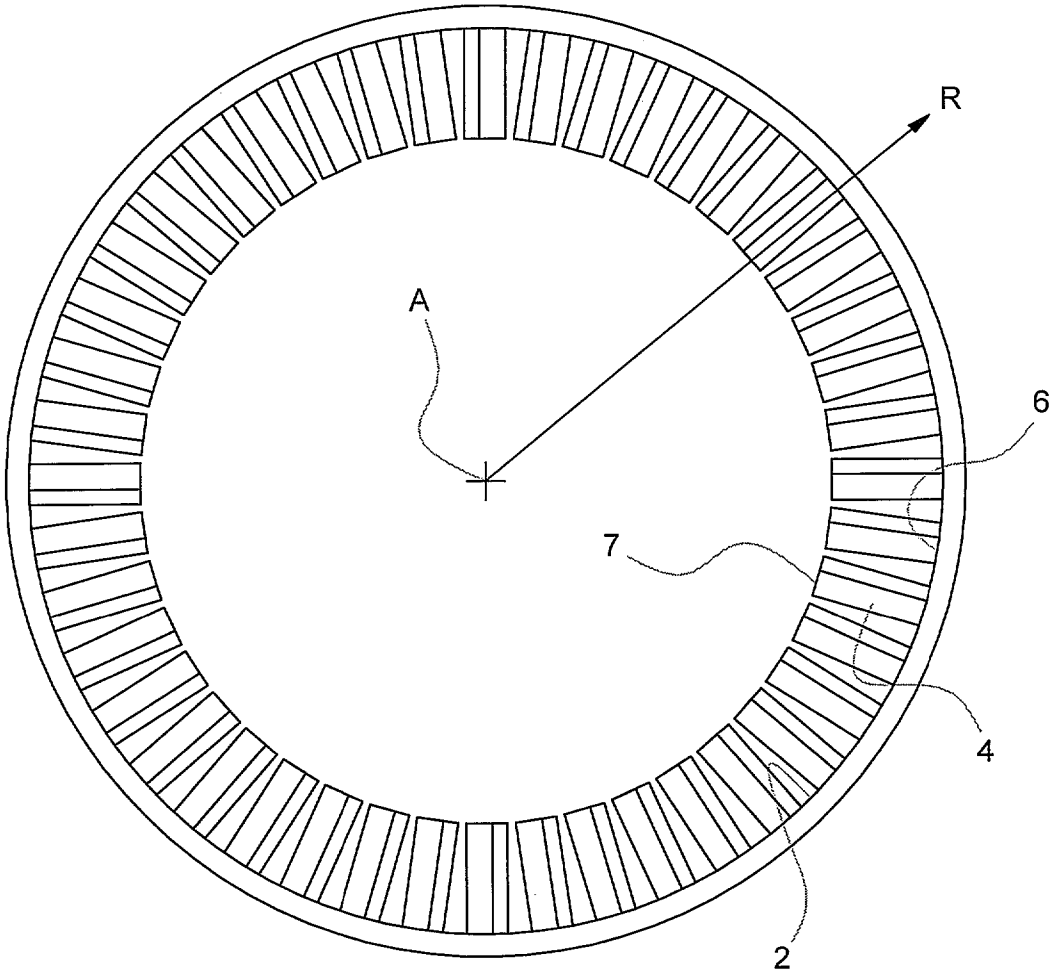
FIG. 2 shows a cross section of the fire tube according to the invention.

Referring to the figures, the fire tube is seen as comprising a tubular body 1 with an inner side surface 2 extending around an axis A, an inlet section 10 and an outlet section 11, a plurality of fins 3 leaning out substantially in radial direction R from the inner side surface 2 towards the axis A.

The tubular body usually has cylindrical shape having circular section. It could however also have cylindrical shape with oval section or in general the shape of ribbed geometrical surface such as, for example, frusto-conical shape or any tubular shape also of a not ribbed surface with an inlet and an outlet. The fins 3 comprise a root 6 intimately contacting the inner side surface 2, an apex 7 and at least one extended surface 4. In the most common case, the fins have substantially rectangular shape, with two extended surfaces and thickness 8. Such fins 3 are arranged on the inner side surface 2, such that the tangent T to the extended surface normal to the radial direction R forms a non-null angle with one of the generatrices of the inner side surface 2, when the inner side surface consists of a ribbed surface, such as for example a cylinder.

In general, said tangent T in a point C to one of the extended surfaces 4 which is normal to the radial direction R is skew with respect to the axis A.

Said tangent T forms a spin angle $\alpha$ higher than 0° and lower than 60° with an axial vector B parallel to the axis A and originating in the same point C of the tangent T. A spin angle $\alpha$ equal to 0° would mean having the fins arranged in the longitudinal direction. A spin angle $\alpha$ higher than 0° produces a spin around the axis A of the fluid passing inside the fire tube, thus promoting the turbulence and the convective heat exchange.

In order to keep pressure drops down, said spin angle α is comprised between 2° and 25°. In the preferred embodiment, said spin angle α is comprised between 5° and 15°.

In case the axis A is curved, the axial vector B is normal to the plane transverse to the axis A containing the origin C of the tangent T.

The fins 3 lean out from the inner side surface 2 and form at least one array S of fins 3, in which the extended surface of a fin is mostly facing that of another fin arranged in succession in the array S. By "facing" it is meant that the normal to the extended surface 4' of a first fin 3' encounters the extended surface 4" of a second fin 3", without encountering anything in-between.

Every array of fins can form a closed or open ring, and the inner side surface 2 can be covered by a plurality of arrays each forming a ring.

Preferably an array S of fins 3 twists around the axis A as progressively proceeds in the axial direction. For example, an array of fins twists around the axis A substantially along a helical path, with constant progression in the axial direction.

Figure 3:
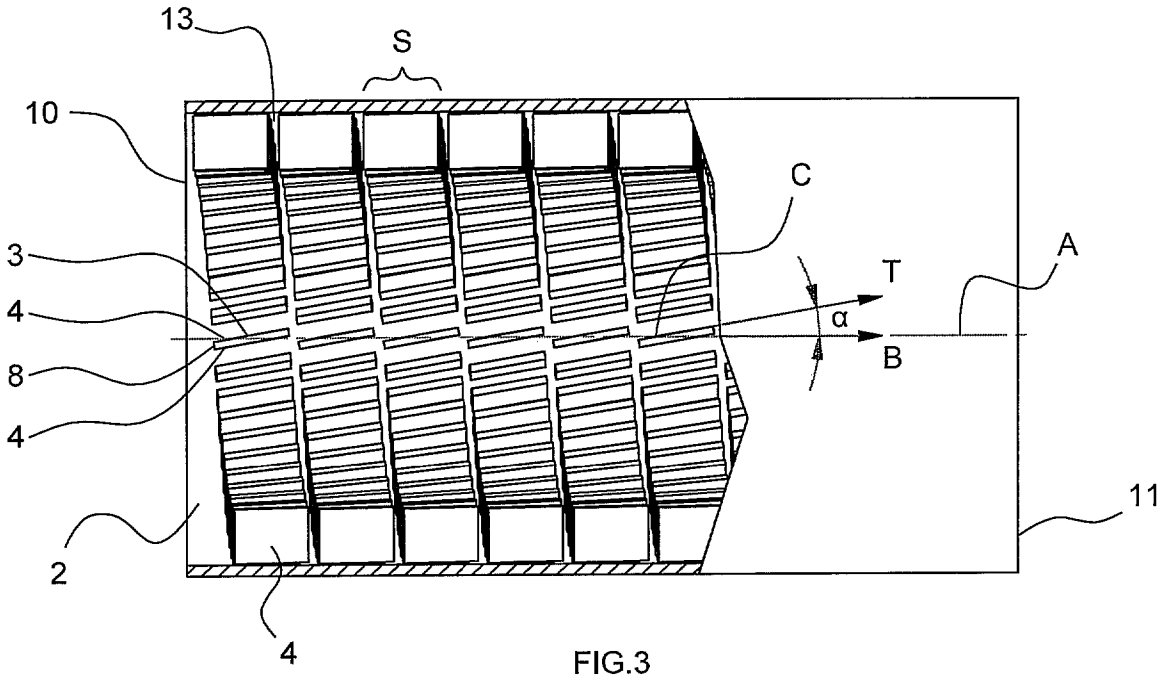
FIG. 3 shows a partial longitudinal section of the fire tube according to the invention.

In the example depicted in FIGS. 1 and 3, the fire tube comprises only one array S of fins leaning out from the inner side surface 2.

Figure 4:
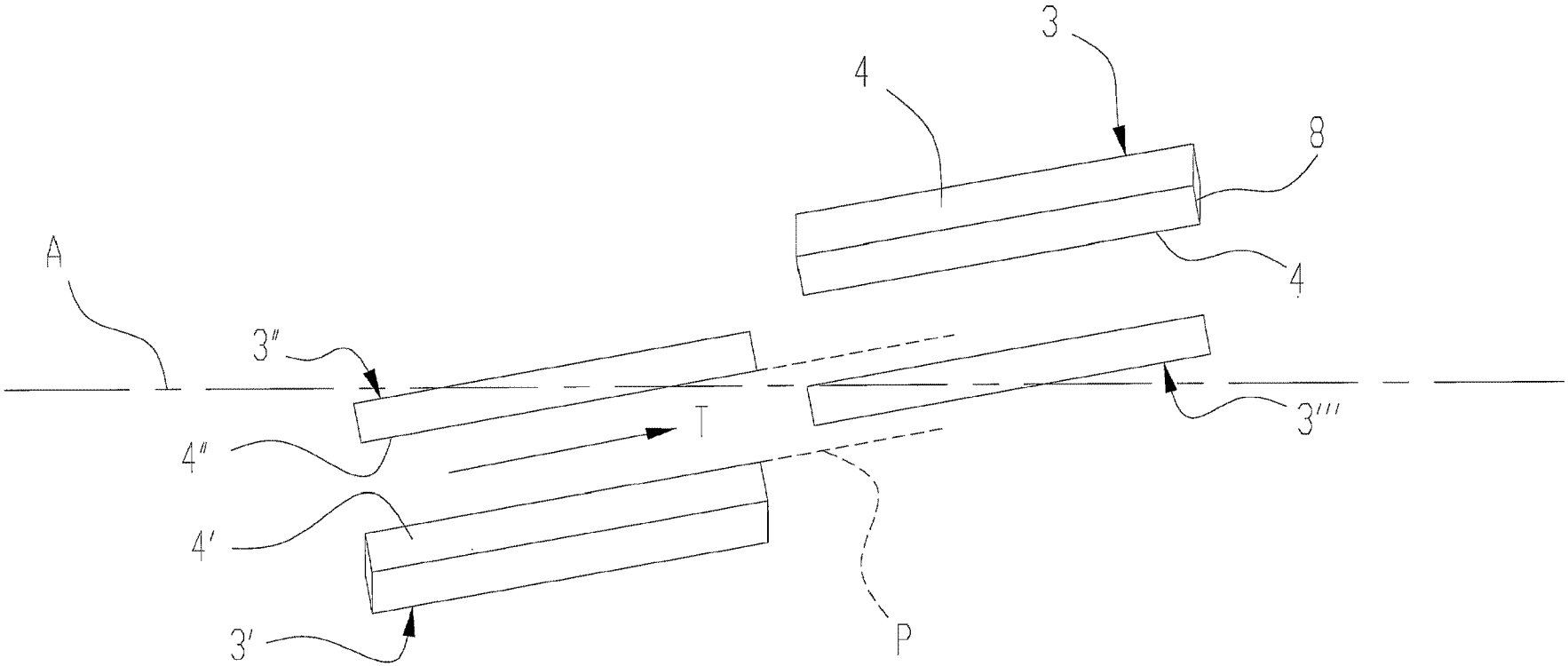
FIG. 4 shows a detail of the mutual arrangement of the fins in the fire tube.

Referring to FIG. 4 it can be seen that, in one of the possible embodiments, the mutual arrangement of the fins is such that a first and a second fin 3' and 3" arranged in succession in an array and thus at least partially facing one another, form an interspace between the respective extended surfaces 4' and 4" facing one another, whose ideal extension P in the direction of the tangent T encounters a third fin 3''' arranged at the interspace outlet. Said third fin 3''' breaks the flow output from the interspace and promotes the convective heat exchange.

It can also be said that the interspaces that the fins form between the respective extended surfaces are misaligned with respect to the interspaces formed by the subsequent fins in the direction of the tangent T.

This interspace misalignment, however already present for example in US 2010/0307729 A1, serves to increase the heat exchange efficiency, since the fluid output from an interspace formed by a first and a second fin 3' and 3", does not insert directly into the subsequent interspace but impacts against a third fin 3''' and increases the motion turbulence.

For higher ease of construction the fire tube comprises only one array S of fins 3, which leans out from the inner side surface 2 and twists around the axis A along a helical path (FIG. 3).

The preferred, but not exclusive, embodiment provides for the fins being arranged in an array twisting along a helical path thus causing a passage 13 without fins between the different helical spires, the passage also twisting along a helical path around the axis A.

The orientation and number of fins allow adjusting the extent of the heat exchange. Fins having higher spin angle α cause higher pressure drop, but exchange more with respect to fins with lower spin angle α. This allows adjusting the temperature of the outer side surface 9 of the fire tube by making it for example more uniform.

Thus the fins, arranged on the inner side surface 2 of the fire tube, advantageously have spin angle α depending on the position of the fins 3 along the axial direction, i.e. on the distance from the inlet section. A continuous variation of the spin angle α with the position in the axial direction of the fins allows a fine adjustment of the heat exchange and temperature on the outer side surface 9.

The height and consequently the surface of the fins 3 in the radial direction R can depend on the position in the axial direction of the fins 3, since by varying the distance from the inlet section the fume temperature varies, and the pressure and relevant specific volume can vary. In general, the fin height increases while moving away from the inlet section 10.

Similarly to US 2010/0307729 A1, starting from a certain distance from the inlet section 10, inside the tubular body 1 of the fire tube at the axis A an ogive (not depicted for the sake of simplicity) is arranged and has the aim of forcing the fumes to pass far from the axis A, inside the interspaces formed between the fins.

The ogive is made of high-temperature resistant material mostly at the nose where it is subjected to high temperature fumes.

Advantageously, the ogive is made such that thermal expansions of the fire tube, that make the apex of the fins move away from the axis A, are compensated by the thermal expansion of the ogive remaining at the fins' apex.

The portion of the fire tube close to the axis towards the inlet section 10 is on the contrary usually intended for accommodating the end portion of the burner and is thus the combustion seat.

Since the described fire tube is particularly adapted to ammonia generators in thermodynamic absorption plants, the present patent is intended also to protect an ammonia generator for a thermodynamic absorption cycle, comprising a fire tube with the above described features.

In its operation, high temperature combustion fumes enter the inlet section 10 of the fire tube and exchange heat with the first portion of the tube. Then the ogive urges the fumes to completely enter the interspaces formed between the extended surfaces facing one another of the fins 3. The fumes move towards the outlet section 11 and, due to the interspace misalignment, when exiting from an interspace they impact against the subsequent fin being on the path in the direction of the tangent T. This increases the flow turbulence and improves the convective heat exchange. Due to the orientation of the fins, the fumes move in the fire tube along a substantially helical path.

It is naturally possible that in the first portion of the fire tube there is still the combustion and not yet the fumes produced by the same.

In case the array of fins is arranged along a helical path twisting around the axis A, the fume passage section is not subjected to abrupt narrowing or widening while moving in the axial direction since, by considering a cross section, when the fumes exit from an interspace, in other angular positions around the axis A the fumes are still inside the other interspaces. For this reason, if the array of fins twists along a helical path, the fumes are subjected to pressure drops lower than those they would be subjected to in case the fins were arranged in many ring arrays around the axis A, which are separated by annular passages without fins as in US 2010/0307729 A1.

The fins' root forming a spin angle α higher than 0° and being thus tilted with respect to the generatrices, that define the inner side surface 2, thereby allows having higher resistance of the tubular body against the flattening due to the external pressure and thermal stresses. Thereby the fins act also as structural elements, i.e. ribs strengthening the structure. Thanks to this, a fire tube with structurally more resistant tubular body can be implemented.

Thanks to the fact that the fin orientation can vary continuously from the inlet section to the outlet section, the designer can determine the desired temperature profile on the outer side surface 9 of the tubular body. This allows for example having more uniform temperature distribution on the outer side surface.

The manufacturing process can be easily automated and allows obtaining high concentration of highly accurately arranged fins.

The invention claimed is:

1. A fire tube comprising a tubular body with an inner side surface, extending around an axis (A), an inlet section and an outlet section, a plurality of fins leaning out, substantially in the radial direction (R), from the inner side surface towards the axis (A), said fins comprising an extended surface whose tangent (T), in a point (C) normal to the radial direction (R), is skew with respect to the axis (A), said fins being arranged in at least one array (S), a first and a second fin, arranged in succession in said array, forming an interspace between the respective extended surfaces facing one another, whose ideal extension (P) in the direction of the tangent (T) encounters a third fin.

2. The fire tube according to claim 1, wherein said tangent (T) in a point (C) to the extended surface forms a spin angle (a) higher than 0° and lower than 60° with an axial vector (B), parallel to the axis (A) and originating in the same point (C).

3. The fire tube according to claim 2, wherein said spin angle ($\alpha$) is between 2° and 25°.

4. The fire tube according to claim 3, wherein said spin angle ($\alpha$) is between 5° and 15°.

5. The fire tube according to claim 1, wherein said array (S) of fins twists around the axis (A) while progressively proceeding in the axial direction.

6. The fire tube according to claim 5, comprising only one array (S) of fins.

7. The fire tube according to claim 5, wherein said array (S) of fins twists around the axis (A) along a helical path.

8. The fire tube according to claim 2, wherein said spin angle ($\alpha$) depends on the position in the axial direction of the fins.

9. The fire tube according to claim 1, wherein the height of said fins depends on the position in the axial direction of the fins.

10. An ammonia generator for a thermodynamic absorption cycle, comprising a fire tube according to claim 1.

* * * * *